US006321387B1

(12) United States Patent
Fukae

(10) Patent No.: US 6,321,387 B1
(45) Date of Patent: Nov. 27, 2001

(54) BALL CATCHING TOOL

(75) Inventor: Toyoharu Fukae, Sakai (JP)

(73) Assignee: Mitsuwa Tiger Co., Ltd., Osaka (JP)

( * ) Notice: Subject to any disclaimer, the term of this patent is extended or adjusted under 35 U.S.C. 154(b) by 0 days.

(21) Appl. No.: 09/367,328

(22) PCT Filed: Feb. 13, 1998

(86) PCT No.: PCT/JP98/00589

§ 371 Date: Aug. 11, 1999

§ 102(e) Date: Aug. 11, 1999

(87) PCT Pub. No.: WO98/35730

PCT Pub. Date: Aug. 20, 1998

(30) Foreign Application Priority Data

Feb. 14, 1997 (JP) ..... 9-030174
Feb. 3, 1998 (JP) ..... 10-022092

(51) Int. Cl.[7] ..... A41D 13/08
(52) U.S. Cl. ..... 2/19; 2/161.1
(58) Field of Search ..... 2/19, 159, 161.1; 473/458

(56) References Cited

U.S. PATENT DOCUMENTS

| | | | | |
|---|---|---|---|---|
| 1,087,292 | * | 2/1914 | Hooper, Jr. | 2/19 |
| 4,346,481 | * | 8/1982 | Latina | 2/19 |
| 4,665,561 | * | 5/1987 | Aoki | 2/19 |
| 4,896,376 | * | 1/1990 | Miner | 2/19 |
| 5,659,897 | * | 8/1997 | Satoh et al. | 2/19 |
| 5,799,327 | * | 9/1998 | Clevenhagen | 2/19 |

FOREIGN PATENT DOCUMENTS

| | | |
|---|---|---|
| 27 21 409 | 11/1978 | (DE) . |
| 57-173773 | 11/1982 | (JP) . |
| 59-41465 | 3/1984 | (JP) . |
| 3-5471 | 1/1991 | (JP) . |
| 3-96870 | 10/1991 | (JP) . |
| 3000339 | 5/1994 | (JP) . |
| 8-215367 | 8/1996 | (JP) . |
| 9-201442 | 8/1997 | (JP) . |

OTHER PUBLICATIONS

Microfilm of the specification and drawings annexed to the request of Japanese Utility Model Application No. 136915/1982 (Laid–open No. 41465/1984) (Hiroyuki Matsumoto), Mar. 16, 1984.

* cited by examiner

*Primary Examiner*—John J. Calvert
*Assistant Examiner*—Katherine Moran
(74) *Attorney, Agent, or Firm*—Merchant & Gould P.C.

(57) ABSTRACT

A tool for catching a ball having an enhanced function to protect a thumb. A part into which the thumb is inserted is formed as a bag-shaped portion which fits a size of the thumb and which surrounds an entire periphery of the thumb. As another embodiment, a thumb insertion hole can be formed at a location which is on a side of a back of a hand and which corresponds to a joint part of the thumb, and a cover can be installed so as to fit a periphery on the side of the back of the thumb which extends outside from the thumb insertion hole.

4 Claims, 3 Drawing Sheets

BALL CATCHING TOOL

TECHNICAL FIELD

The present invention relates to a ball catching tool, such as a mitt or a glove, which is used for a baseball game or a softball game.

BACKGROUND ART

As a ball catching tool which is used in a baseball game or in a softball game, a glove, a catcher's mitt, or a first baseman's mitt, is well known. Generally, the glove, or the mitt, which is used in the baseball game or the softball game, is functionally designed in consideration of both the function to protect a user's hand, and the function to facilitate a ball catching action and a ball throwing action (an action of passing a ball from a ball catching hand to a skillful hand) in accordance with a feature of play at each fielding position. For example, the mitt has a shape which is designed more in consideration of the function to catch a ball, in contrast with the glove. Particularly, the catcher's mitt is required to have a structure which is suitable for catching the ball being thrown by a pitcher at a very high speed.

The hand's fingers are accommodated inside the catcher's mitt in such a manner that the thumb and the other four fingers are opposed to each other. The position (sweet spot) which is the most suitable for catching the ball and which exerts less shock upon the hand at time of catching the ball, locates near a root part between the thumb and the forefinger. The hand is not injured if the ball is received in the sweet spot.

However, for example, a ball which a batter foul-tips changes its course abruptly, immediately before the catcher receives the ball; therefore, the ball often misses the sweet spot and hits the catcher's mitt. In such a case, the force of the ball is exerted upon the palm or each finger accommodated inside the catcher's mitt unnaturally and in irregular directions; as a result, the force thereof may cause the catcher's hand to be injured. In particular, the hand is injured more often when the foul-tipped ball misses the sweet spot and hits the catcher's mitt on a side near the thumb than when the foul-tipped ball misses the sweet spot and hits the catcher's mitt on a side near the four fingers opposite to the thumb.

The main reason can be that the force of the ball is received only by one finger when the foul-tipped ball hits the catcher's mitt on the side near the thumb, in contrast with the fact that the force of the ball is received by a plurality of fingers when the foul-tipped ball hits the catcher's mitt on the side near the four fingers other than the thumb. Unexpectedly enough, there seems to be another reason for the above which is often based upon a problem relating to a holding structure for holding the thumb inside the mitt.

With respect to the conventional mitt, each of the forefinger and the middle finger is respectively inserted into a bag-shaped portion, which generally conforms to the size of each finger so as to allow each finger to be entirely inserted therein. The third finger (ring finger) and the little finger are inserted together into one bag-shaped portion, within which only the little finger is passed through a loop-shaped portion made of a strap. Also, the thumb is passed through a loop-shaped portion made of a strap. Each of the loop-shaped portions made of the straps, pulls the thumb and the little finger, respectively, in a direction in which they are kept open wide so as to catch the ball easily. In order to pull the fingers in the direction in which they are kept open, the strap is arranged as follows. That is, one end of the strap is sewn to a surface, with which the palm of the hand inserted into the mitt or the inner part (belly part) of the finger of the hand contacts, of a leather of the mitt. More specifically, the one end of the strap is sewn to be fixed to the surface thereof at an outer edge of a so-called bank part of the surface thereof. The strap extends from the side of the inner part of the finger to the back side (outer side) thereof along an inner side of the finger. The other end of the strap is formed as a forked part with a pair of ends. Each of the pair of ends is passed through an opening formed on a back leather, with which the back (or outer side) of the hand inserted into the mitt or the back (or outer side) of the finger of the hand contacts, of the mitt, and the pair of ends of the strap are knotted with each other outside the back leather. With respect to the strap thus arranged, the thumb is fitted to the strap in a direction in which the same finger is closed, thus possible to preferably control the closing action of the mitt (at time of catching the ball).

The structure for holding the thumb and the little finger with such a strap as aforementioned, is favorable for the movement of the mitt in the direction in which the finger is closed. However, the structure allows the finger to freely move within the loop-shaped portion in a direction in which the fingers are opened. With such an arrangement, if the hand is put inside in the mitt, and if a foul-tipped ball misses the sweet spot and hits the bank portion on the thumb side for example, a shock is not directly applied to the hand; however, the mitt is instantaneously deviated with respect to the hand so that the mitt is twisted, or turned, with respect thereto in a direction of the shock. Under the situation in which the mitt is deviated with respect to the hand, if the force of the ball further pushes the mitt, a force is exerted upon the thumb in an unnatural direction. As a result, it seems that the thumb, particularly a joint part of the thumb, gets injured. Meanwhile, if the same situation occurs on the side of the little finger, it may seem that the little finger also gets injured. However, if the ball hits the bank portion on the little finger side, the four fingers other than the thumb, the palm of the hand, and the outer side of the hand, are rotated together about the wrist (or they are rotated together in a direction in which the shock, or impact, is absorbed and reduced) rather than the force of the ball is exerted upon the one little finger. That is, the shock does not concentrate upon one location; instead, the shock is apt to disperse over the whole part of the hand. Therefore, it is less probable that the hand is injured, and it is much less probable that only the little finger is injured.

On the other hand, as an irregular use of the mitt, the hand can be accommodated inside the mitt even if the finger is not inserted through the loop-shaped portion of the strap. In case that the mitt becomes soft as it is used for a longer time, the user has a sense (or feeling) of less incongruity even if the strap is not positioned in its original position. Accordingly, there is some possibility that the user puts the mitt on the hand without inserting the thumb through the loop-shaped portion involuntarily. Under such a situation of usage thereof, the mitt is particularly unstable relative to the hand, and it is not possible to surely catch, or receive, the ball.

The structure for supporting the thumb by the loop-shaped portion of the strap is adopted not only for the catcher's mitt, but also for the glove and the first baseman's mitt. It is not so often that the glove or the first baseman's mitt receives the ball under such a hard condition as that under which the catcher's mitt is placed. However, similar to the catcher's mitt, it is expected that the loop-shaped portion of the strap of glove or the first baseman's mitt has an effect to protect the joint part of the thumb.

The structure which allows the mitt or the glove not to be fitted to the hand and to be easily deviated relative to the hand when the foul-tipped ball hits the bank portion on the thumb side, for example, as aforementioned, seems to be a cause for injuring, particularly, the joint part, or root part, of the thumb of the hand. Therefore, the improvement of the structure is desired.

The present invention is intended to effectively solve the technical problem, as aforementioned, of the prior art, in view of the problem thereof. Accordingly, it is an object of the present invention to provide a ball catching tool in which a fittable nature between the hand and the mitt on the side of the thumb, or between the hand and the glove on the side of the thumb, is enhanced, so that the thumb can be less injured.

DISCLOSURE OF THE INVENTION

A mitt according to the present invention has a construction, in which there are provided a pad part and a back leather which covers a back of a hand and which is connected to a rear side of the pad part to form a space, between the pad part and the back leather, into which the hand is inserted, in which the back leather comprises a pair of pieces of leather of which a bag-shaped portion into which a thumb of the hand can be inserted is made, in which the pair of pieces of leather are sewn to each other generally linearly at a part which corresponds to a ridge of the thumb so that the bag-shaped portion is formed in three dimensions, and in which the back leather is sewn to the pad part along a pair of side edges of the bag-shaped portion so as to fit an inner edge part of the thumb and an outer edge part thereof.

A ball catching tool according to the present invention has a construction in which there is provided a thumb insertion hole at a location which corresponds to a joint part, on a side of a back, of a thumb, and in which there is further provided a cover which fits an entire periphery, on the side of the back, of the thumb extending outside from the thumb insertion hole, so that a play of the thumb therein is substantially restricted by the cover.

A mitt, as the ball catching tool according to the present invention, has a construction in which there are provided a pad part and a back leather which is connected to the pad part to form a space, between the pad part and the back leather, into which a hand is inserted, in which there is formed a thumb insertion hole on the back leather at a position which corresponds to a joint part of the thumb, in which there is provided a cover which fits an entire periphery on a side of a back of the thumb which extends outside from the thumb insertion hole so as to substantially restrict a play of the thumb, in which a space, formed between the back leather and the pad part, into which a part of a thenar eminence is inserted, is sectioned by connecting the back leather and the pad part to each other, in a position extending from a location near crotch between the thumb and a forefinger along an inner edge of the thumb, and in a position extending along an outer edge of the thenar eminence from a wrist of the hand to the joint part of the thumb, under a situation in which the hand is inserted thereinto, and in which the thenar eminence and a back of the thenar eminence fit the pad part and the back leather, substantially without a play therein.

With the construction, the mitt or the glove is held with a state in which almost all the part of the thumb fits the mitt or the glove. Compared with a conventional construction in which the thumb is held by the loop-shaped portion made of the strap, the user can have a greater feeling (or sense) of unity that the mitt, or the glove, is a part of his/her hand. With the construction, even if a ball, like a foul-tipped ball, strikes against the bank portion on the thumb side of the mitt or the glove, the mitt or the glove is less deviated, or shifted, relative to the hand. Therefore, a force exerted upon the joint part, or root part, of the thumb in an unnatural direction (or an irregular direction) is greatly diminished and the joint part of the thumb is hardly injured.

BEST MODE FOR CARRYING OUT THE INVENTION

Figure 1:
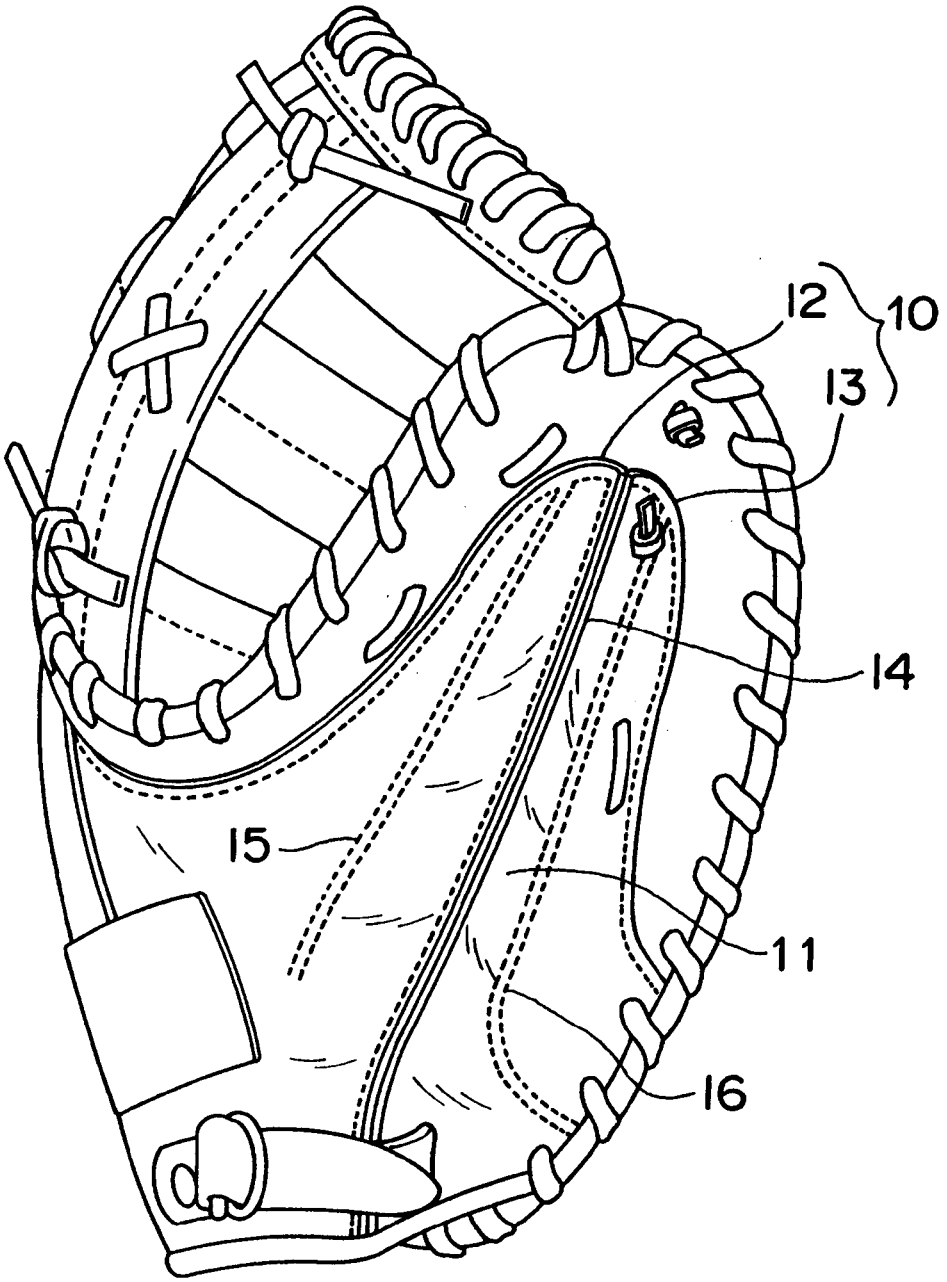
FIG. 1 is a front view showing a catcher's mitt which is an embodiment of a ball catching tool according to the present invention.

FIG. 1 is a front view, shown from a side of a thumb, of a catcher's mitt as an example of a ball catching tool according to the present invention. A characteristic construction of the catcher's mitt is a structure of a part into which the thumb is inserted. A back leather 10 which covers a back of a hand, has two pieces 12, 13 of leather for forming a bag-shaped portion 11 into which a user's thumb is inserted. The two pieces 12, 13 of leather are employed to form the bag-shaped portion 11 in three dimensions. The two pieces 12, 13 of leather are sewn substantially linearly along a part 14 corresponding to a back, or ridge, of the thumb. Both side edges 15, 16 of the bag-shaped portion 11 are sewn to a pad part along an inner side of the thumb and an outer side thereof. The construction of a part except the part into which the thumb is inserted, is similar to that of the conventional mitt.

In a state in which the thumb is in the bag-shaped portion 11, the thumb is kept open wide relative to the little finger so as to allow the catcher's mitt to catch a ball easily. Thus, as soon as the catcher's mitt receives the ball, the user can close the thumb.

As described above, the bag-shaped portion 11 can fit an entire periphery of the thumb. Accordingly, for example, even if a foul-tipped ball strikes against the bank portion on the thumb side of the catcher's mitt, the mitt is hardly deviated, or shifted, relative to the hand. Or, even if the mitt is somewhat deviated or shifted relative thereto, the deviation or shift is smaller than that which occurs in case of the mitt in which the thumb is supported by the loop-shaped portion made of the strap. Therefore, a force exerted upon the joint part, or root part, of the thumb in an unnatural direction (irregular direction) is greatly diminished, and the joint-part of the thumb is hardly injured.

In case that the mitt is the one in which there is provided the loop-shaped portion made of the strap, the hand can be put inside the mitt without inserting the finger of the hand into the loop-shaped portion made of the strap. On the other hand, in case of the mitt of the embodiment, the hand cannot be put inside the mitt without inserting the finger thereof into it. Namely, in case of the mitt of the embodiment, the thumb is surely inserted into the bag-shaped portion 11; therefore, the mitt is brought into a state in which the mitt is securely put on the hand.

Figure 2:
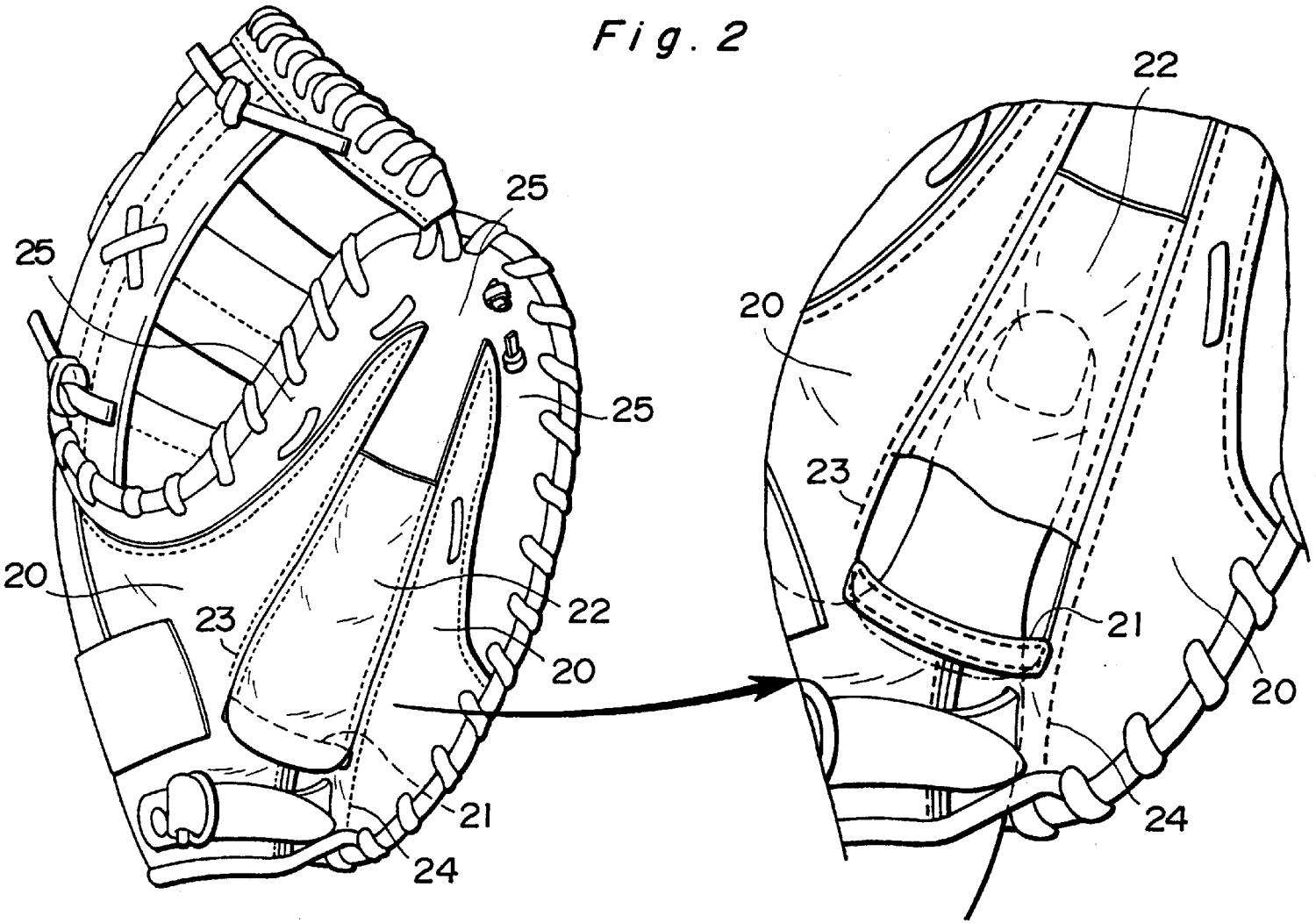
FIG. 2 is a front view showing a catcher's mitt which is another embodiment of the ball catching tool according to the present invention, and also showing a main part thereof as an enlarged partially broken view.

FIG. 2 is a front view, shown from the side of the thumb, of a catcher's mitt as another example of the ball catching tool according to the present invention. The mitt generally has a pad part which forms thick like a pad so as to reduce a shock exerted upon the palm of the hand inserted into the mitt, at time of receiving a ball. The mitt has a back leather, covering the back of the hand, which is sewn to a side of a rear surface of the pad part to form a bag-shaped space, between the pad part and the back leather, into which each finger can be inserted. The embodiment shown in FIG. 2 of the present invention has a characteristic construction of a part which holds the thumb within the mitt. A back leather 20 which covers the back of the hand, covers a part on a side of its back of the thumb which is opposite to a thenar eminence thereof and which is on a side of the joint part of the thumb. As shown therein as an enlarged and partially broken view showing a main part thereof, the back leather 20 covers up to a part corresponding to an approximately intermediate position between a first joint locating on a side of the thumb's tip and a second joint locating on a side of the thumb's root (or thumb's joint), where there is formed a thumb insertion hole 21 at the approximately intermediate position therebetween. Namely, the finger's tip part is positioned outside the back leather 20 from the thumb insertion hole 21.

With respect to the thumb positioned outside the back leather 20 from the thumb insertion hole 21, a cover 22 is mounted, sewn and fixed, on the pad part 25 so as to cover a periphery of the thumb. The cover 22 is mounted thereon so as to fit the thumb along all the periphery of the side of the back (rear) of the thumb. That is, when the thumb is inserted inside the cover 22, the thumb has little play within the cover 22. Accordingly, the user can have a sufficient feeling of a unity as if the mitt is a part of his/her hand.

Further, in a situation in which the hand is inserted inside the mitt, the back leather 20 is sewn to the pad part 25 at a part 23 which extends from a location near a crotch between the thumb and the forefinger along an inner edge of the thumb, and is sewn to the pad part 25 at a part 24 which extends along an outer edge of the thenar eminence, of the thumb, from the wrist to the root (or joint) of the thumb. A space which is sectioned between the sewn part 23 and the sewn part 24, and which forms between the back leather 20 and the pad part 25, is well-fitted to the thenar eminence of the joint part of the thumb and to a part of the back thereof, thus enhancing the feeling of a unity that the mitt is a part of the hand. By the way, the construction of a part except the part holding the thumb, is similar to that of the conventional mitt.

By the way, in the embodiment shown in FIG. 2, a part of the back leather 20 corresponding to a part from the thumb insertion hole 21 towards a tip part of the back leather 20 is cut off. Alternatively, there may remain the tip part of the back leather 20 to be formed as the bag-shaped portion into which the thumb is inserted, similar to the bag-shaped portion of an ordinary mitt. In this case, too, by forming a thumb insertion hole so as to allow the thumb to be positioned outside the back leather, and by mounting the cover from above the back leather, the mitt can be used like the mitt shown in FIG. 2.

In a state in which the thumb is in the cover 22, the thumb is kept open wide relative to the little finger so as to allow the mitt to catch a ball easily. Thus, as soon as the mitt receives the ball, the user can close the thumb.

As described above, the cover 22 can fit all the periphery on the side of the surface of the back (or rear) of the thumb, so that the play of the thumb therein can be substantially restricted. Accordingly, for example, even if a foul-tipped ball strikes against the bank portion on the thumb side of the mitt, the mitt is hardly deviated, or shifted, relative to the hand. Or, even if the mitt is somewhat deviated or shifted relative thereto, the deviation or shift is less than that which occurs in case of the mitt in which the thumb is supported by the loop-shaped portion made of the strap. Therefore, a force exerted upon the joint part, or root part, of the thumb in an unnatural direction (or an irregular direction) is greatly diminished, and the joint part of the thumb is hardly injured. In particular, the sewn part 23 and the sewn part 24 enhance a fittable nature (or a fittable quality) around a part of the thenar eminence, so that the feeling of the unity that the mitt is a part of the user's hand is more enhanced. Namely, the function to catch the ball and the function to protect the root part of the thumb are further increased, as well as the enhancement of the fittable nature by the cover 22.

In case that the mitt is the one in which there is provided the loop-shaped portion made of the strap, the hand can be put inside the mitt without inserting the finger thereof into the loop-shaped portion. On the other hand, in case of the mitt of the embodiment, the hand cannot be put inside the mitt without inserting the finger thereof into it. Namely, in case of the mitt of the embodiment, the thumb is surely inserted through the thumb insertion hole 21, and it is surely held by the cover 22, so that the mitt is all the time put on the hand properly.

Figure 3:
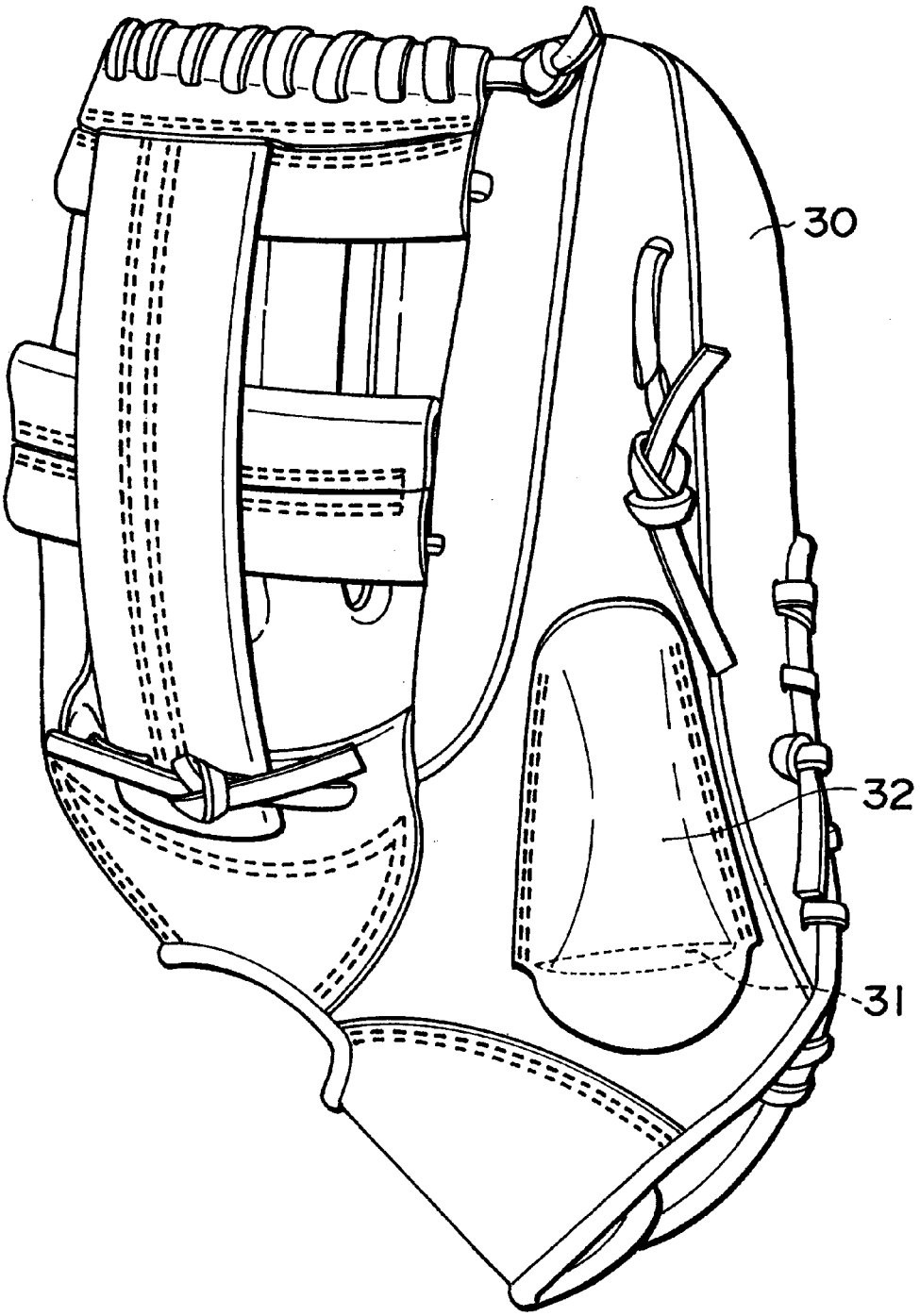
FIG. 3 is a front view showing a glove which is still another embodiment of the ball catching tool according to the present invention.

The present invention is particularly effective to an application to the catcher's mitt as described above. Also, even if the present invention is applied to a glove, the same utility is realized. FIG. 3 illustrates an embodiment in which the thumb insertion hole and the cover are applied to the glove. Unlike the mitt, in case of the glove, the back leather is not sewn on the pad part, and there is formed a bag-shaped portion 30 into which the thumb is inserted. Therefore, a thumb insertion hole 31 is formed on a part of the glove, on the side of the back of the hand, corresponding to the joint part of the thumb, as shown by a dot line, and a cover 32 is sewn to an outside thereof. The cover 32 is also mounted thereon so as to relatively tightly fit an entire part, of the thumb, extending outside from the thumb insertion hole 31. Needless to say, it is also effective to form in the glove a bag-shaped portion which fits an entire periphery of the thumb being inserted thereinto.

INDUSTRIAL APPLICABILITY

As described above, the ball catching tool according to the present invention is held with a state in which almost the entire thumb is fitted to the mitt or the glove. Therefore, in contrast with an arrangement in which the thumb is supported by the conventional loop-shaped portion made of the strap, a greater feeling that the mitt or the glove is a part of the hand, is realized. Also, in contrast with the arrangement, even if a ball, like a foul-tipped ball, strikes against the bank portion on the thumb side of the mitt or the glove, the mitt or the glove is less deviated, or shifted, relative to the hand. Therefore, a force exerted upon the joint part, or root part, of the thumb in an unnatural direction (or an irregular direction) is greatly reduced, and the joint part of the thumb is hardly injured. That is, it has a high function to protect the user's thumb.

What is claimed is:

1. A mitt, comprising:

a pad part; and a back leather portion which covers a back of a hand and which is connected to a rear side of the pad part to form a space, between the pad part and the back leather portion, into which the hand is inserted, the back leather portion comprising a pair of pieces of leather assembled to form a bag-shaped portion into which a thumb of the hand can be inserted; and a first line of stitches and a pair of a second line of stitches;

wherein the pair of pieces of leather are sewn to each other with said first line of stitches generally linearly at a part which corresponds to a ridge of the thumb so that the bag-shaped portion is formed in three dimensions, and wherein the back leather portion is sewn to the pad part along a pair of side edges of the bag-shaped portion with said pair of second line of stitches so as to fit an inner edge part of the thumb and an outer edge part thereof.

2. A ball catching tool, comprising:

a pad part;

a back leather portion including a thumb opening at a position which is on a side of the back leather portion and which corresponds to a join part of a thumb; and a cover sewn to one of the back leather portion and the pad part which fits a periphery, on the side of the back thereof, of the thumb which extends outside from the thumb opening.

3. A mitt, comprising:

a pad part; and a back leather portion which is connected to the pad part to form a space, between the pad part and the back leather portion, into which a hand is inserted, wherein there is formed a thumb opening on the back leather portion at a position which corresponds to a joint part of the thumb, wherein there is provided a cover which fits a periphery on a side of a back of the thumb which extends outside from the thumb, opening wherein a space, formed between the back leather portion and the pad part, into which a part of a thenar eminence is inserted, is sectioned by connecting the back leather portion and the pad part to each other, in a position extending from a location near a crotch between the thumb and a forefinger along an inner edge of the thumb, and in a position extending along an outer edge of the thenar eminence from a wrist of the hand to the joint part of the thumb, under a situation in which the hand is inserted thereinto, and wherein the pad part and the back leather portion fit the thenar eminence and a back of the thenar eminence.

4. A ball catching tool comprising a portion for receiving fingers and a portion for receiving a thumb, characterized in that a part into which a thumb is inserted is formed as a bag-shaped part that generally conforms to a shape of the thumb and that surrounds an entire periphery of the thumb.

* * * * *